US012723397B1

(12) United States Patent
Peterson

(10) Patent No.: US 12,723,397 B1
(45) Date of Patent: Sep. 1, 2026

(54) NESTED HOUSE

(71) Applicant: Nathan Peterson, Phoenix, AZ (US)

(72) Inventor: Nathan Peterson, Phoenix, AZ (US)

( * ) Notice: Subject to any disclaimer, the term of this patent is extended or adjusted under 35 U.S.C. 154(b) by 70 days.

(21) Appl. No.: 18/603,818

(22) Filed: Mar. 13, 2024

Related U.S. Application Data

(60) Provisional application No. 63/529,768, filed on Jul. 30, 2023.

(51) Int. Cl.
*E04B 1/343* (2006.01)
*E04B 1/344* (2006.01)
*E04H 15/46* (2006.01)

(52) U.S. Cl.
CPC ..... *E04B 1/3431* (2013.01); *E04B 1/34305* (2013.01); *E04B 1/34317* (2023.08); *E04B 1/34336* (2013.01); *E04B 1/34384* (2013.01); *E04B 1/344* (2013.01); *E04B 1/3444* (2013.01); *E04H 15/46* (2013.01)

(58) Field of Classification Search
CPC .... E04B 1/3431; E04B 1/34336; E04B 1/344; E04B 1/34305; E04B 1/3444; E04B 1/34384; E04B 1/34317; B60P 3/34; E04H 15/46
See application file for complete search history.

(56) References Cited

U.S. PATENT DOCUMENTS 2,636,773 A * 4/1953 Van ..... B60P 3/34 296/172
5,170,901 A * 12/1992 Bersani ..... E04B 1/34336 296/26.14
5,634,683 A 6/1997 Young
5,732,839 A 3/1998 Schimmang et al.
6,067,756 A 5/2000 Frerichs et al.
6,257,638 B1 7/2001 Graber
6,447,048 B2 9/2002 Crean
6,623,058 B1 9/2003 Crean
6,851,734 B2 * 2/2005 Findley ..... B62D 61/12 296/171
7,150,483 B2 12/2006 Rasmussen
7,290,372 B2 11/2007 Aust et al.
8,141,304 B2 3/2012 Shen et al.
9,080,326 B2 7/2015 Johnson et al.
11,391,036 B2 7/2022 Crozier
2003/0213185 A1 * 11/2003 Findley ..... E04B 1/3431 52/64
2004/0256874 A1 12/2004 Rex
2005/0055891 A1 3/2005 Kuebler
2006/0076798 A1 4/2006 Kunz
2010/0192481 A1 * 8/2010 Shen ..... E04B 1/3444 52/79.5
2011/0023381 A1 * 2/2011 Weber ..... E04B 1/3431 52/79.5

(Continued)

*Primary Examiner* — Brent W Herring
(74) *Attorney, Agent, or Firm* — IPTechLaw

(57) ABSTRACT

Implementations of nested houses may include a first portion having a stationary wall, a convertible wall and a first floor, and a second portion having a first movable wall, a second movable wall, and a third movable wall. The second portion may be movable with respect to the first portion between a compact position and an extended position. The second portion may be configured to nest within the first portion. The convertible wall may be configured to rotate downwards to form a second floor of the second portion in the extended position.

20 Claims, 14 Drawing Sheets

(56) References Cited

U.S. PATENT DOCUMENTS

| | | | | |
|---|---|---|---|---|
| 2011/0214362 | A1 | 9/2011 | Huang | |
| 2014/0090312 | A1* | 4/2014 | Medley | E04B 1/3444 52/79.5 |
| 2015/0084368 | A1 | 3/2015 | Tenpenny | |
| 2015/0292194 | A1* | 10/2015 | Calafatis | E04B 1/34321 52/67 |
| 2016/0288690 | A1 | 10/2016 | Wills | |
| 2021/0079644 | A1* | 3/2021 | Jewell | E04B 1/34336 |

* cited by examiner

NESTED HOUSE

CROSS REFERENCE TO RELATED APPLICATIONS

This document claims the benefit of the filing date of U.S. Provisional Patent Application 63/529,768, entitled "NESTED SHIPPING CONTAINERS" to Peterson which was filed on Jul. 30, 2023, the disclosure of which is hereby incorporated entirely herein by reference.

BACKGROUND

1. Technical Field

Aspects of this document relate generally to nested units, such as shipping containers, cubical units or modular home components. More specific implementations involve expanding the nested units to increase the usable space while retaining the ability to return the internal space back to the original size.

2. Background

Recreational vehicles and containers may include extensions, slide outs, or pop outs that are generally limited by the amount of additional space provided, may be flimsy and may expose internal space to the environment during setup, storage and/or breakdown.

SUMMARY

Implementations of nested houses may include a first portion having a stationary wall, a convertible wall and a first floor, and a second portion having a first movable wall, a second movable wall, and a third movable wall. The second portion may be movable with respect to the first portion between a compact position and an extended position. The second portion may be configured to nest within the first portion. The convertible wall may be configured to rotate downwards to form a second floor of the second portion in the extended position.

Implementations of nested houses may include one, all, or any of the following:

The convertible wall may be pivotable between the compact position and the extended position.

The first portion may include a first roof.

Either a bathroom fixture or a kitchen fixture may be secured to the first floor of the stationary wall.

In the extended position, an upper surface of the first floor may be planar with an upper surface of the second floor.

Implementation of the nested house may include a tracks below the upper surface of the first floor and the upper surface of the second floor.

The track may include a base and a rail. The rail may be configured to slide within the base.

The stationary wall of the first portion may be in meshing engagement with one of the first movable wall, second movable wall or third movable wall of the second portion.

The meshing engagement may occur in an upper half of the stationary wall and an upper half of the first movable wall.

At least one of the first movable wall, the second movable wall, or the third movable wall may be mounted on wheels or casters.

Implementations of the nested house may include a track for engaging the casters.

The track may be below an upper surface of the first floor or an upper surface of the second floor.

Implementations of the nested house may include fixtures attached to at least one of the first movable wall, the second movable wall, or the third movable wall.

At least one of the first movable wall, the second movable wall, or the third movable wall may be recessed into one of the first floor or the second floor.

The nested house may include a trailer with the first portion resting on the trailer.

Implementations of nested houses may include a first portion having a first stationary wall, a second stationary wall, and a third stationary wall, a stationary floor, and a stationary ceiling, and a second portion having a first movable wall, a second movable wall, a third movable wall, and a movable ceiling. Implementations of nested houses may include a foldable wall. The first portion may be configured to nest within the second portion or the second portion may be configured to nest within the first portion. The foldable wall may be configured to fold down from a wall position to a floor position under the second portion. A width of the first portion perpendicular to a longest length of the first portion may be substantially the same as a width of the second portion perpendicular to a longest length of the second portion.

Implementations of nested houses may include a track recessed in the foldable wall.

The second portion may be movable with respect to the first portion, wherein in the floor position, the second portion is moved away from the first portion such that the foldable wall forms a floor under the second portion.

Implementations of nested houses may include a trailer, a first portion on the trailer, the first portion having a stationary wall, a convertible wall and a first floor, a second portion having a first movable wall, a second movable wall, and a third movable wall, the second portion movable with respect to the first portion between a compact position and an extended position, the second portion configured to nest within the first portion, and a track recessed into the convertible wall. The convertible wall may be configured to rotate downwards to form a second floor of the second portion in the extended position. The second portion may engage track in the extended position.

At least one of the first movable wall, the second movable wall, or the third movable wall may be mounted on casters.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended nested house will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such nested components and nested house, and implementing components and methods, consistent with the intended operation and methods.

Figure 1:
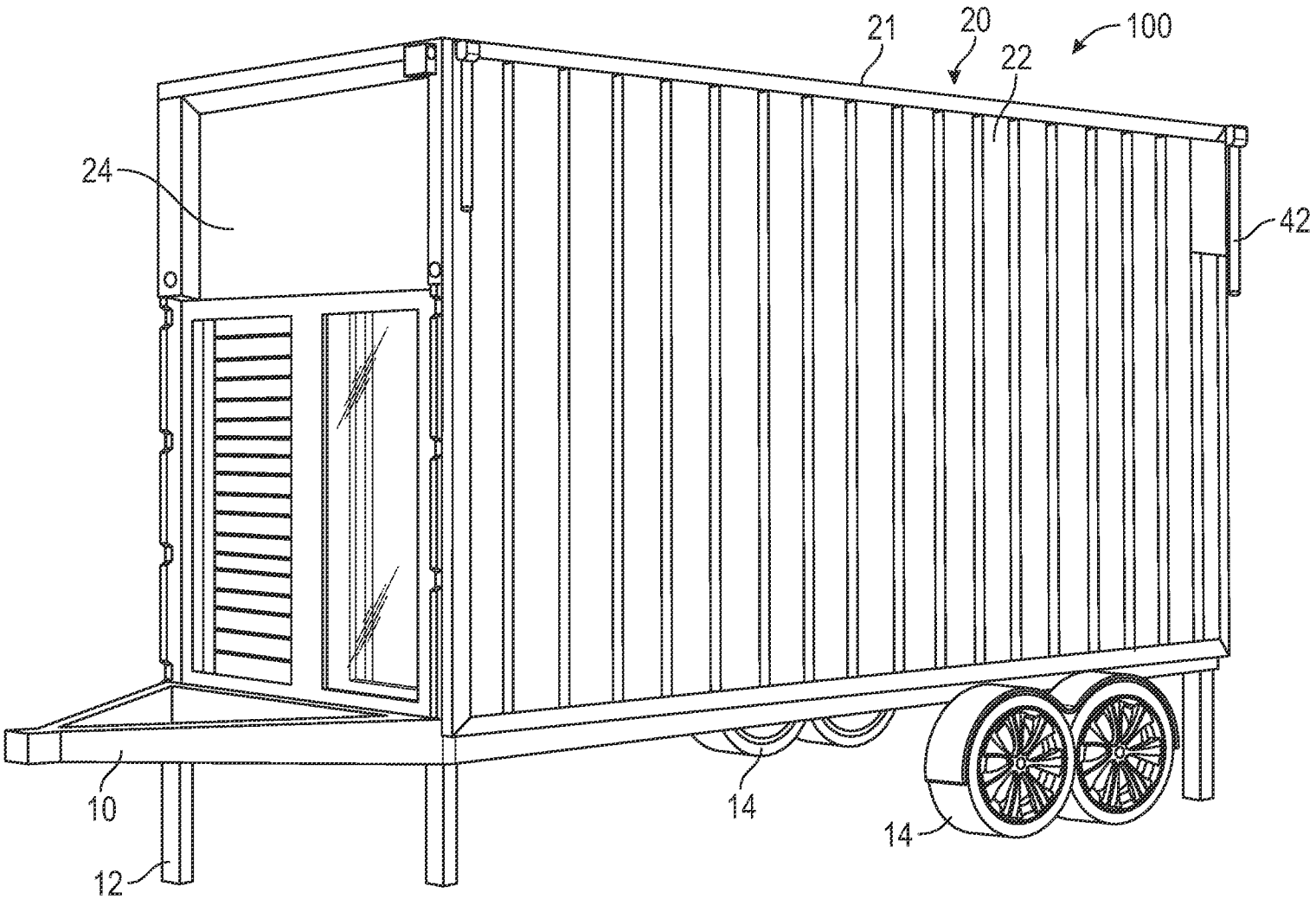
FIG. 1 is a perspective view of an implementation of a nested house in a closed position.
Figure 2:
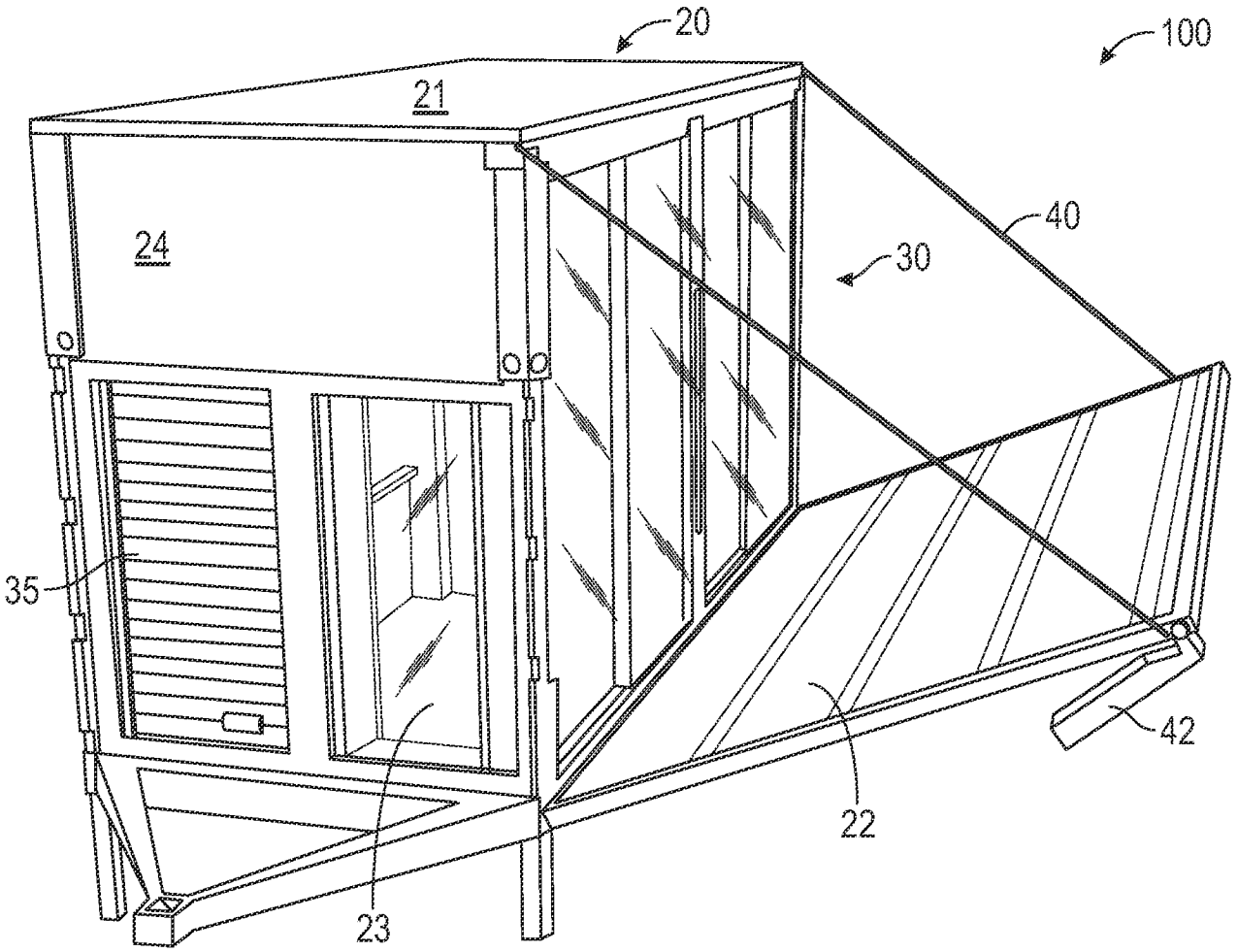
FIG. 2 is a perspective view of the nested house of FIG. 1 with the convertible wall folded partially downwards.

FIG. 1 illustrates a perspective view of an implementation of a nested house in a closed position. The nested house 100 includes a first component or portion 20 and a second component or portion 30 (FIG. 2). The second portion 30 is able to nest within the first portion 20 as illustrated in FIGS. 1 and 2. In other words, the second portion 30 is configured to fit inside first portion 20 or vice versa. In various implementations, and as illustrated by FIG. 1, the nested house 100 is mounted on a trailer 10. In such implementations, the nested house may be removably coupled on a trailer or the nested house may be fixed to and integrally formed with the trailer so. The nested house 100 may be towed by a vehicle or otherwise moved to a desired location before being assembled into an extended position. Trailer 10 may include legs 12 and wheels 14. Though not illustrated, legs 12 may be retractable and extendable. When the trailer is moving the legs 12 may be retracted. When the trailer is parked and the house is to be deployed the legs 12 may be extended in order to provide stability for the house. Each of the legs 12 may be configured to extend to a custom length in order to accommodate the trailer being parked on uneven surfaces.

Referring now to FIGS. 1, 2, 5 and 8, first portion 20 includes a convertible wall 22, three sidewalls 24, 26, 28, a ceiling or roof 21 and a floor 23. In the implementation shown and described in FIGS. 1 to 8, sidewalls 24, 26, 28, roof 21 and floor 23 are stationary with respect to second portion 30 and are intended to remain stationary once a location for the nested house 100 has been selected. Sidewalls 24, 26, 28 and roof 21 may include doors, windows, framing, etc. as desired. Nested house 100 may be composed of any suitable materials, including, for example, shipping containers, building materials, modular home materials, recyclable materials, steel, glass, wood, bamboo, and plastics.

Nested house 100 is configured to move from a compact position illustrated in FIG. 1 in which second portion 30 is nested inside first portion 20 to an extended position illustrated in FIGS. 5 to 8 in which second portion 30 is displaced away from first portion 20. In the extended position, the internal space or living space of nested house 100 increases and in some implementations, the internal space or living space may double in size or may nearly double in size. In particular implementations the width of the second portion may be 95% of the width of the first portion. In further implementations the internal space may increase by 96% when the nested house 100 is moved into the extended position.

FIG. 2 shows an initial step of moving nested house 100 from the compact position of FIG. 1 to the extended position illustrated in FIGS. 5 to 8. Convertible wall 22 is rotated downward towards the ground to form a platform adjacent to first portion 20. Legs 42 connected to an exterior of convertible wall 22 are extended to serve as supports for the platform created by rotating convertible wall 22 towards the ground. Legs 42 may be configured to lie flush against the convertible wall 22 when the wall is in an upright position. In such implementations, legs 42 may be configured to rotate perpendicular to the convertible wall 22 when the convertible wall is rotated to form the platform 22*a*. In other implementations, the legs 42 may not be rotatable but may be configured to removably attach to the convertible wall 22 in an orientation perpendicular to the convertible wall folded down to form the platform 22*a*. The height of legs 42 may be adjustable in order to accommodate for a level and stable surface over uneven ground surfaces. Cables 40 connected on one end to first portion 20 and on the other end to convertible wall 22 may provide additional support and/or prevent convertible wall 22 from contacting the ground in an undesired manner.

Figure 3:
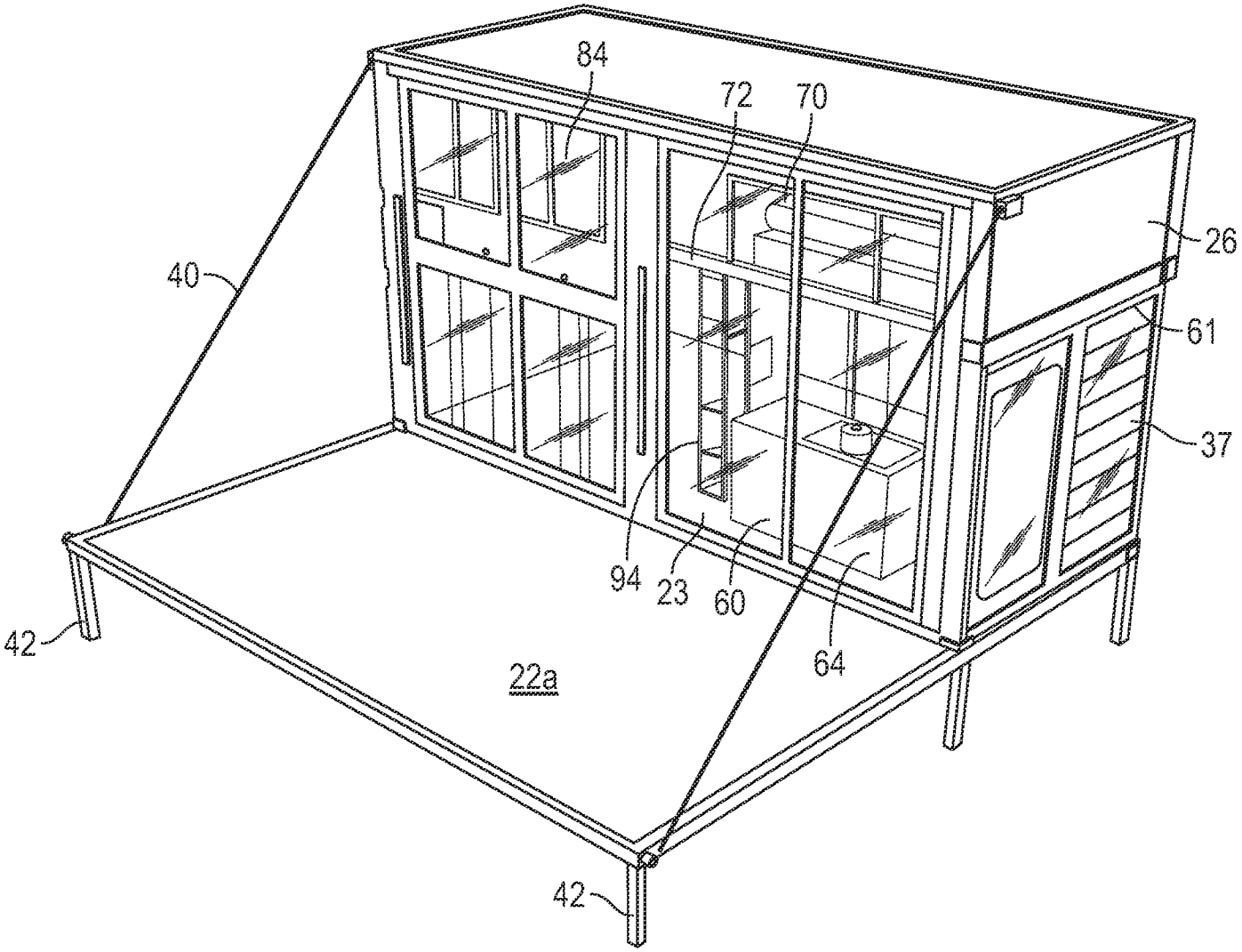
FIG. 3 is a perspective view of the nested house of FIG. 1 with the convertible wall fully folded downward to form a second floor portion.

FIG. 3 illustrates convertible wall 22 of nested house 100 in a platform position. Convertible wall 22 is rotated until wall 22 is parallel or nearly parallel with the ground and/or planar or nearly planar with floor 23 of first portion 20. Legs 42 are extended to contact the ground and bear weight. Thus, in this platform position convertible wall 22 serves as a platform 22*a* that can bear weight and serve as a "floor", patio, deck, etc. For example, if desired, chairs, a table or a grill may be placed on platform 22*a* in the configuration illustrated in FIG. 3. Having the platform 22*a* separate from second portion 30 allows trailer 10 and first portion 20 to be stabilized and secure before moving second portion 30 and reduces the chances that trailer 10 and/or first portion 20 may tip or fall over. In the compact position, convertible wall 22 may also protect second portion 30 from the environment and elements, including potential damage from being towed (such as rocks or other debris hitting the trailer while traveling on a highway). In turn, clear, lightweight or delicate materials (such as glass) may be used for any or all of the sidewalls or roof of the second portion 30 inasmuch as they are covered during transport.

Figure 4:
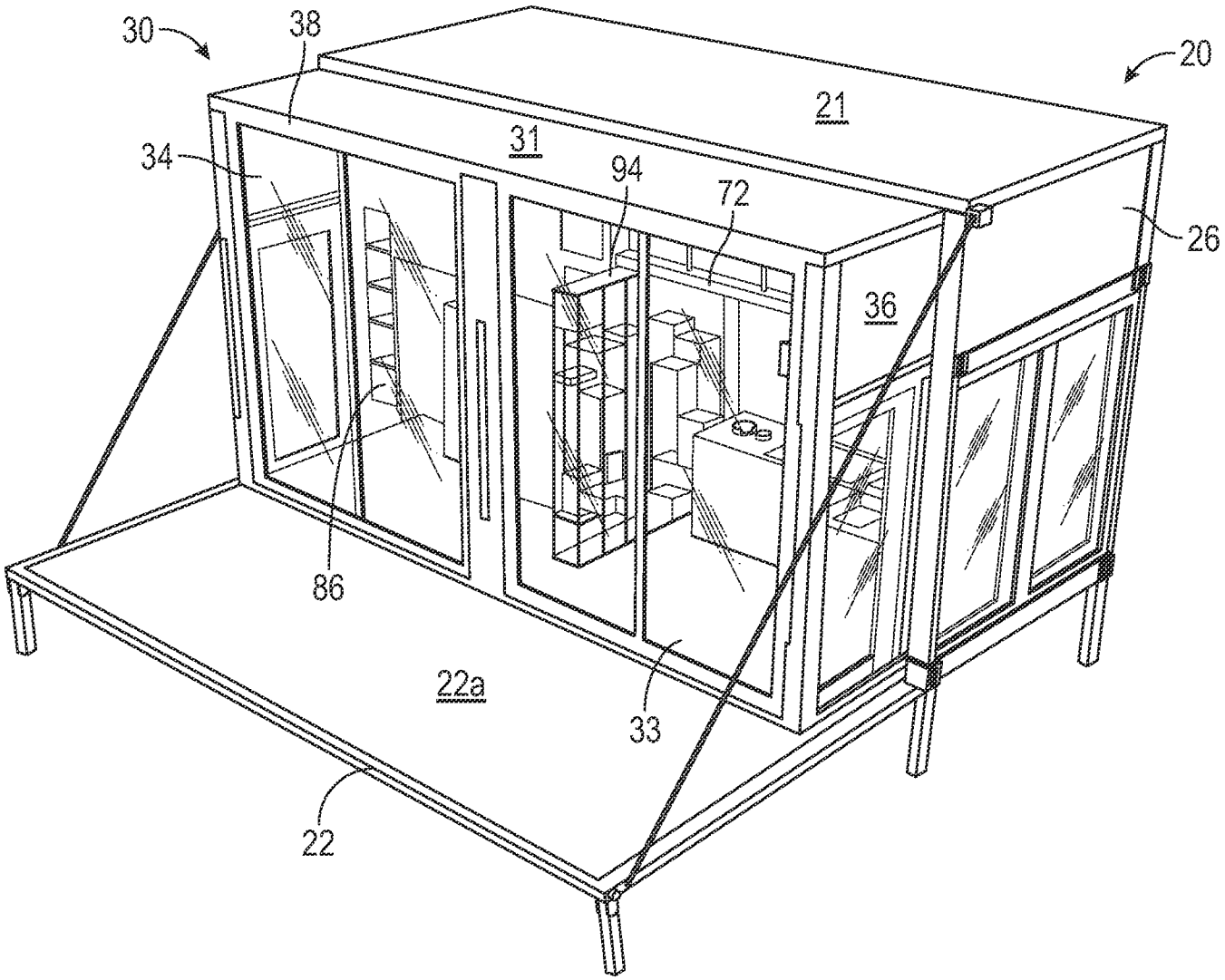
FIG. 4 is a perspective view of the nested house of FIG. 3 with the slide-out portion partially extended.
Figure 5:
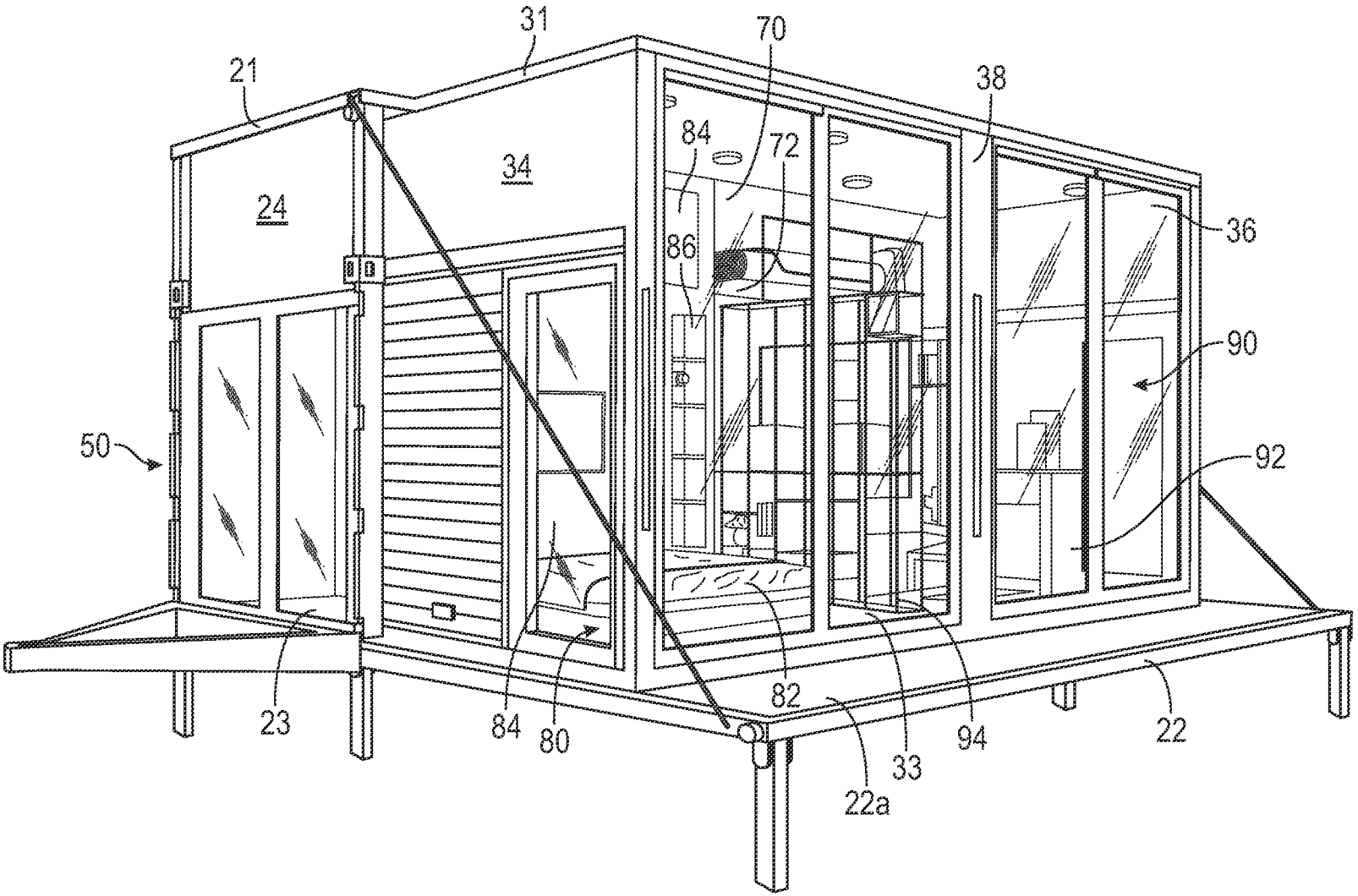
FIG. 5 is a perspective view of the nested house of FIG. 1 in an extended position.

Referring now to FIGS. 4 and 5, second portion 30 is pulled away from first portion 20 thereby increasing an interior space of nested house 100. Second portion 30 includes three sidewalls 34, 36, 38 and a ceiling or roof 31. Second portion 30 does not include a separate "floor" or bottom wall. In the compact position, floor 23 of first portion 20 serves as a floor of second portion 30, i.e., second portion 30 is open towards floor 23. Second portion 30 is also open towards sidewall 28. As second portion 30 is moved away from first portion 20 and onto platform 22*a*, platform 22*a*/convertible wall 22 becomes a floor 33 of second portion 30. Thus, convertible wall 22 moves from a vertical position in which convertible wall 22 serves as a wall of first portion 20 to a horizontal position in which convertible wall serves as a platform 22*a* adjacent first portion and/or as a floor 33 of second portion 30 once second portion 30 is moved thereon.

Since the second portion 30 does not include a fourth wall or floor, the second portion 30 may weigh less. As a result, heavier and/or more durable building materials may be used while still allowing second portion 30 to weigh less than first portion 20 or alternative components.

As illustrated in FIGS. 4 and 5, sidewalls 34, 36, 38 and roof 31 are movable with respect to first portion 20. Sidewalls 34, 36, 38 and roof 31 may include doors, windows, framing, etc. as desired. Convertible wall 22 and second portion 30 may be movable manually, via physical exertion, pneumatic devices, pumps, etc. Convertible wall 22 and second portion 30 may be secured in place, for example, via locks or fasteners, at desired positions.

As shown in FIGS. 1 to 5, the internal space of first portion 20 and second portion 30 remains internal to walls 24, 26, 28, 34, 36, 38 and ceilings 21, 31. Thus, an internal space of nested house 100 is generally not exposed to and protected from the environment and elements during setup, storage and breakdown.

Figure 6:
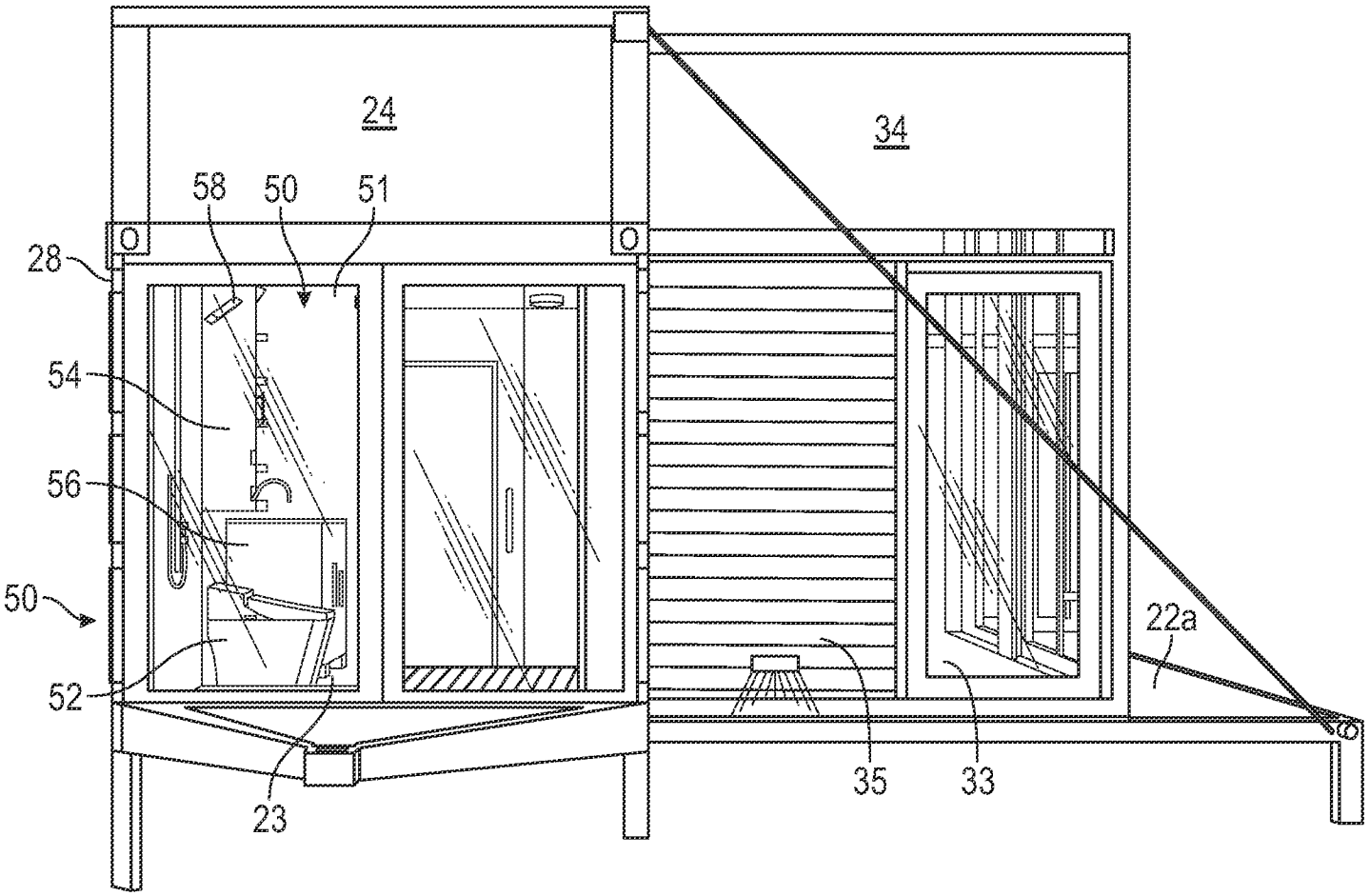
FIG. 6 is a left side view of the nested house of FIG. 5.
Figure 7:
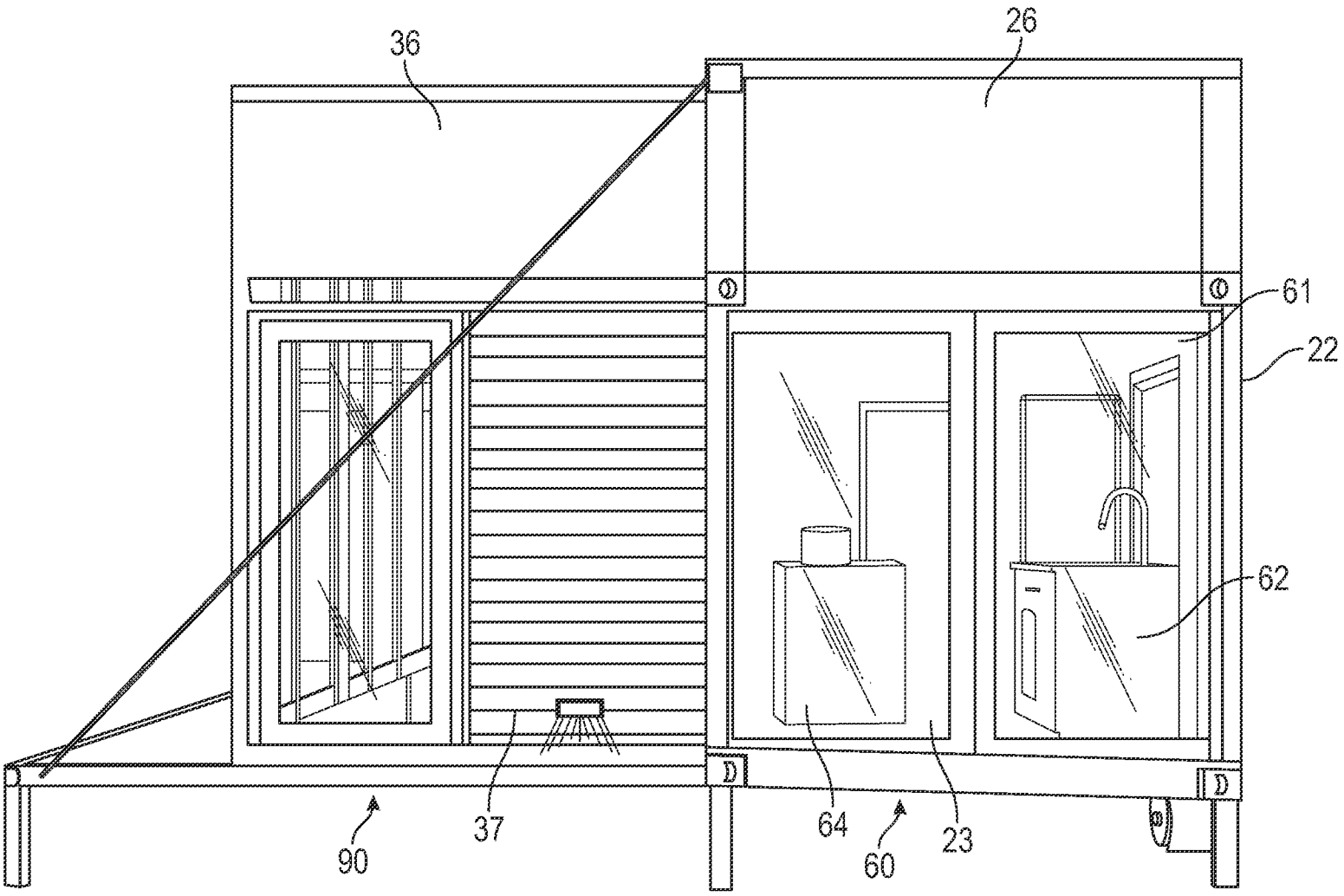
FIG. 7 is a right side view of the nested house of FIG. 5.

Referring now to FIGS. 5 to 7, nested house 100 may include a variety of living spaces or rooms due to the increase in internal usable space. First portion 20 may include a bathroom 50, kitchen 60 and loft 70, and second portion 30 may include a bedroom 80 and a living room 90. Various spaces or rooms may be designed or configured as desired in first portion 20 and second portion 30.

In the implementation illustrated in FIGS. 1 to 8, first portion 20 is configured to include any desired fixtures that may remain fixed or mounted in place and/or are difficult to move since first portion 20 remains stationary with respect to second portion 30. These desired fixtures may include plumbing fixtures and kitchen appliances, for example. Specifically, desired plumbing is connected to floor 23 and/or sidewall 28 such that second portion 30 can slide into and out of first portion 20 without affecting plumbing fixtures.

Referring now to FIG. 6, FIG. 6 illustrates a toilet 52 and sink mounted to floor 23 and a vanity 54 and shower mounted to sidewall 28. These features are illustrated through a bathroom window 51 of sidewall 24. Fixtures 52, 54, 56, 58 may be mounted or fixed to floor 23 and sidewall 28 as desired. With respect to bathroom 50, as second portion 30 is moved out of and into first portion 20, sidewall 34 is adjacent an interior side of sidewall 24, such that sidewall 34 of second portion 30 slides into a space between shower 58 and sidewall 24. Shower 58, toilet 52, vanity 54 and sink 56 may remain in place without interference from second portion 30 as second portion 30 moves into and out of first portion 20. As illustrated in FIG. 2, a wooden panel feature 35 of sidewall 34 may be seen through window 51 of sidewall 24 when second portion 30 is nested into first portion 20. Shower 58 and toilet 52 are arranged in an area internal to second portion 30 when second portion 30 is nested inside first portion 20.

Similarly, FIGS. 3 and 7 illustrate kitchen 60 arranged in an internal space of second portion 30 when second portion 30 is nested within first portion 20 in such a manner that moving second portion 30 into and out of first portion 20 does not interfere with fixtures such as sink 62 and cabinet 64. Sink 62 is mounted to floor 23 and/or sidewall 28 and a cabinet 64 is mounted to floor 23, for example. These features 62, 64 are illustrated through a window 61 of sidewall 26. With respect to kitchen 60, as second portion 30 is moved out of and into first portion 20, sidewall 36 is adjacent an interior side of sidewall 26, such that sidewall 36 of second portion 30 slides into a space between cabinet 64, sink 62 and sidewall 26. Sink 62 and cabinet 64 may remain in place without interference from second portion 30 as second portion 30 moves into and out of first portion 20. As illustrated in FIG. 3, a wooden panel feature 37 of sidewall 36 may be seen through window 61 of sidewall 26 when second portion 30 is nested into first portion 20. Sink 62 and cabinet 64 are arranged in an area internal to second portion 30 when second portion 30 is nested inside first portion 20.

Referring now to FIGS. 3 and 5, in a similar fashion, second portion 30 is configured to move from the compact position to the extended position without interfering with any fixtures attached to the floor of the first portion. In various implementations, the sidewalls of the second portion 30 may have fixtures attached thereto (such as a TV, shelving, cabinets, or pictures). In this manner the fixtures in the house, including the fixtures attached to the floor and the walls, will automatically be in the desired position when the second portion is extended from the first portion without the need to further rearrange the fixtures.

Similarly, second portion 30 may be configured to move from the compact position to the extended position without interfering with loft 70 which is fixed in first portion 20. The platform 72 support for loft 70 may be cantilevered from the back sidewall 28 and/or supported by pillars fixed to floor 23. In the nested position, sidewall 36 of second portion 30 is between an edge of platform 72 and sidewall 26. Thus, platform 72 is not configured to be mounted to sidewall 26. In various implementations, designs can be configured such that platform 72 is mounted to sidewall 26 and a ceiling of second portion 30 is designed to slide below platform 72 instead of above platform 72. In this configuration, ceiling 31 would be lower than ceiling 21 by a height of loft 70.

FIG. 5 illustrates nested house 100 in an extended position. The internal space of nested house 100 in the extended position is greater than that of the internal space in the compact position, and may be, for example, double or nearly double in size. The increase in size may provide a more desirable living arrangement. As illustrated in FIGS. 4 and 5, in the extended position, second portion 30 includes a bedroom 80 and a living room 90. Bedroom 80 includes a fold down bed 82 connected to an internal wall 84 having shelving 86 therein. Internal wall 84 is mounted to floor 23 of first portion 20 and thus remains stationary. Living room 90 includes a storage cabinet 92 mounted to sidewall 36 and room dividers 94. The room divider 94 may include a wall and may be configured to slide out with the rest of the second portion from the compact to extended positions. The configuration and design of bedroom 80 and living room 90 is such that components fixed to sidewalls 34, 36 are arranged to slide into first portion 20 without interfering with any installed or mounted fixtures of first portion 20. For example, cabinet 92 of living room 90 is configured to fit adjacent cabinet 64 of kitchen 60 in the compact position. In another example, sidewall 34 and ceiling 31 may nest into first portion 20 without affecting internal wall 84 which is mounted to floor 23. In yet another example, room divider 94 may slide into and out of kitchen 60 adjacent cabinet 64 and internal wall 84.

FIGS. 3 to 8 illustrate exemplary design configurations; many other configurations may be employed. In some implementations, fixtures may be mounted to interior sidewalls 34, 36 of the movable second portion 30 and fixtures may be mounted or fixed to the floor 23 or back sidewall 28 of the stationary first portion 20 such that the fixtures in first portion 20 remain fixed and the fixtures mounted to sidewalls 34, 36 of second portion 30 move together with the sidewalls 34, 36 as the second portion 30 is moved between the compact and extended positions.

Figure 8:
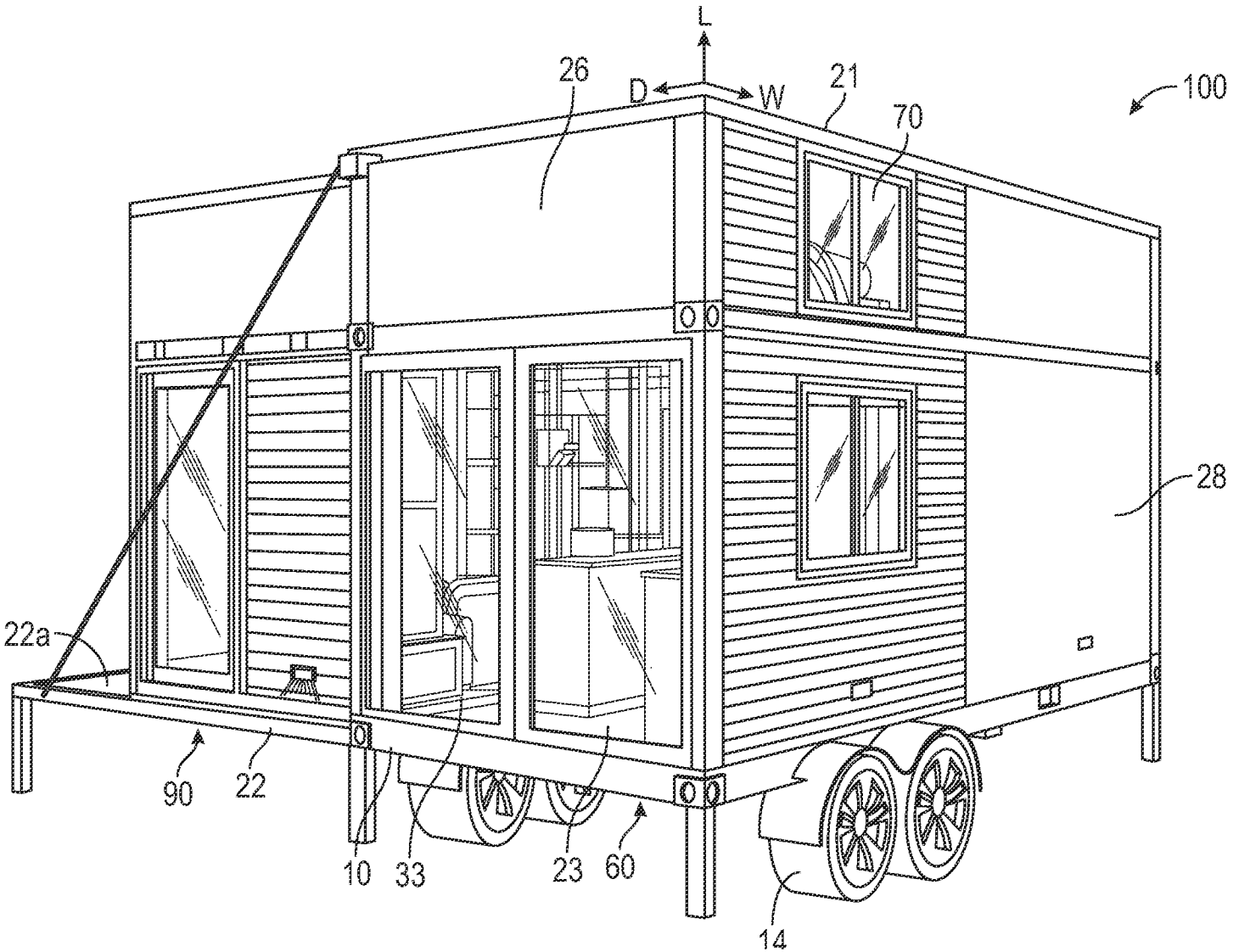
FIG. 8 is a perspective view of the nested house of FIG. 5.

FIG. 8 is a perspective view of the nested house 100 in the extended position. As illustrated, convertible wall 22 rotates downward to serve as floor 33 of second portion 30. In the extended position, an upper surface of floor 33, is planar with an upper surface of floor 23 of first portion 20 such that the floors 33, 23 are level or planar or approximately level or planar.

While the implementation illustrated by FIGS. 1-8 illustrate the second portion 30 as essentially doubling the volume of the house when in the extended position, in other implementations the second portion may only be 75% of the length of the house, 50% of the length of the house, or any other percent less than 90%.

As illustrated in FIGS. 1 and 8, wheels 14 are attached to trailer 10 such that wheels 14 do not interfere with the convertibility of wall 22 from a vertical position to a horizontal position. As further illustrated, in some implementations, a length L of nested house 100 is greater than a depth D of nested house 100 in the compact position, such that when nested house 100 is in the extended position, a portion of convertible wall 22 does not serve as a floor 33 for second portion 30. As shown in FIG. 8, an upper surface of convertible wall 22 includes a platform 22*a* and floor 33. In various implementations, a length, width and depth of first portion 20 is greater than a length, width and depth of second portion 30 such that second portion 30 can nest within first portion 20. In further implementations, a length, width and depth of first portion 20 is slightly greater than a length, width and depth of second portion 30 such that second portion 30 can nest snugly within first portion 20.

Figure 9:
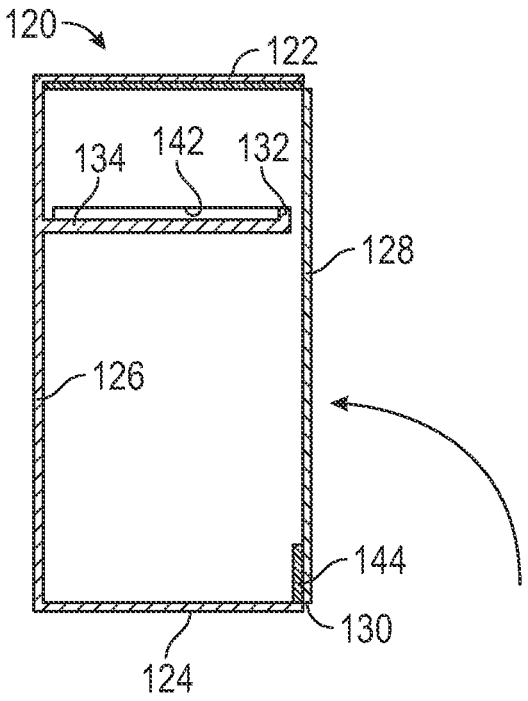
FIG. 9 is a schematic side view of an implementation of nested components.
Figure 10:
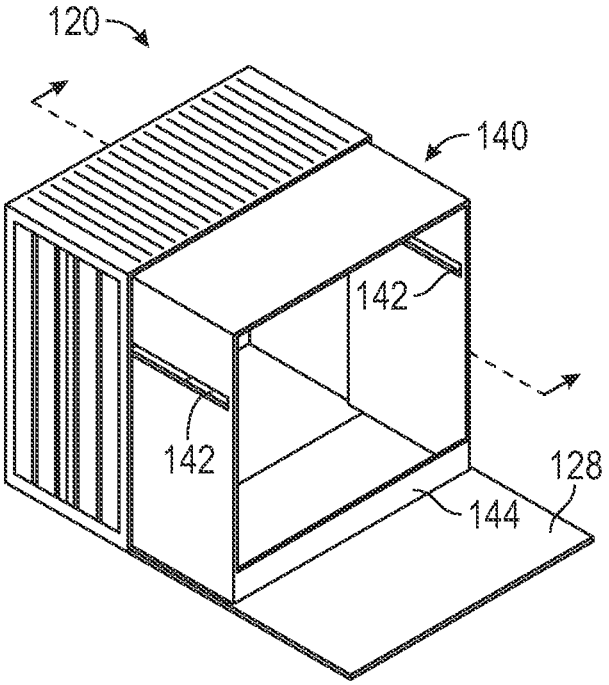
FIG. 10 is a schematic perspective view of the nested components of FIG. 9 in an extended position.
Figure 11:
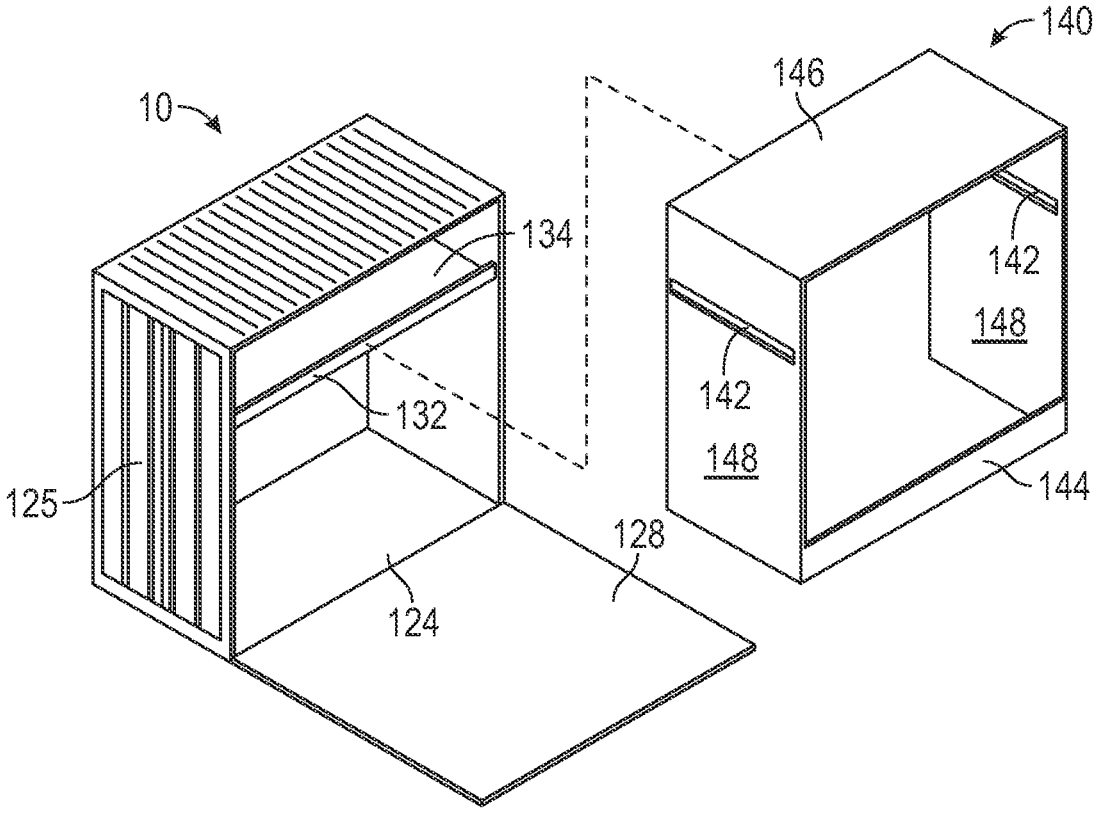
FIG. 11 is a schematic exploded view of the nested components of FIG. 10.

FIGS. 9 to 11 are schematic views of an implementation of a container or component 120 having a nested component 140 therein. Component 110 includes a back wall 126, a top wall 122, a floor wall 124, two sidewalls 125, and a rotatable wall 128 which rotates about a pivot point 130 to form an extension of floor with floor wall 124. Component 110 also includes a bracket 134 having a faceplate 132. Nested component 140 includes two sidewalls 148, a top wall 146 and a faceplate 144 extending between sidewalls 148. Faceplate 144 provides additional support and integrity of nested component 140. Nested component 140 also includes slots 142 for meshing with bracket 134 of component 110. As illustrated in FIG. 10, nested component 140 is configured to be moved into and out of component 120. As illustrated in FIGS. 9 and 11, slots 142 do not extend across a full width of sidewalls 148. Rather slots 142 are configured such that nested component 140 cannot be pulled entirely out of component 110, to help with the alignment of nested component 140 and component 120 as nested component 140 moves with respect to component 110.

Figure 12:
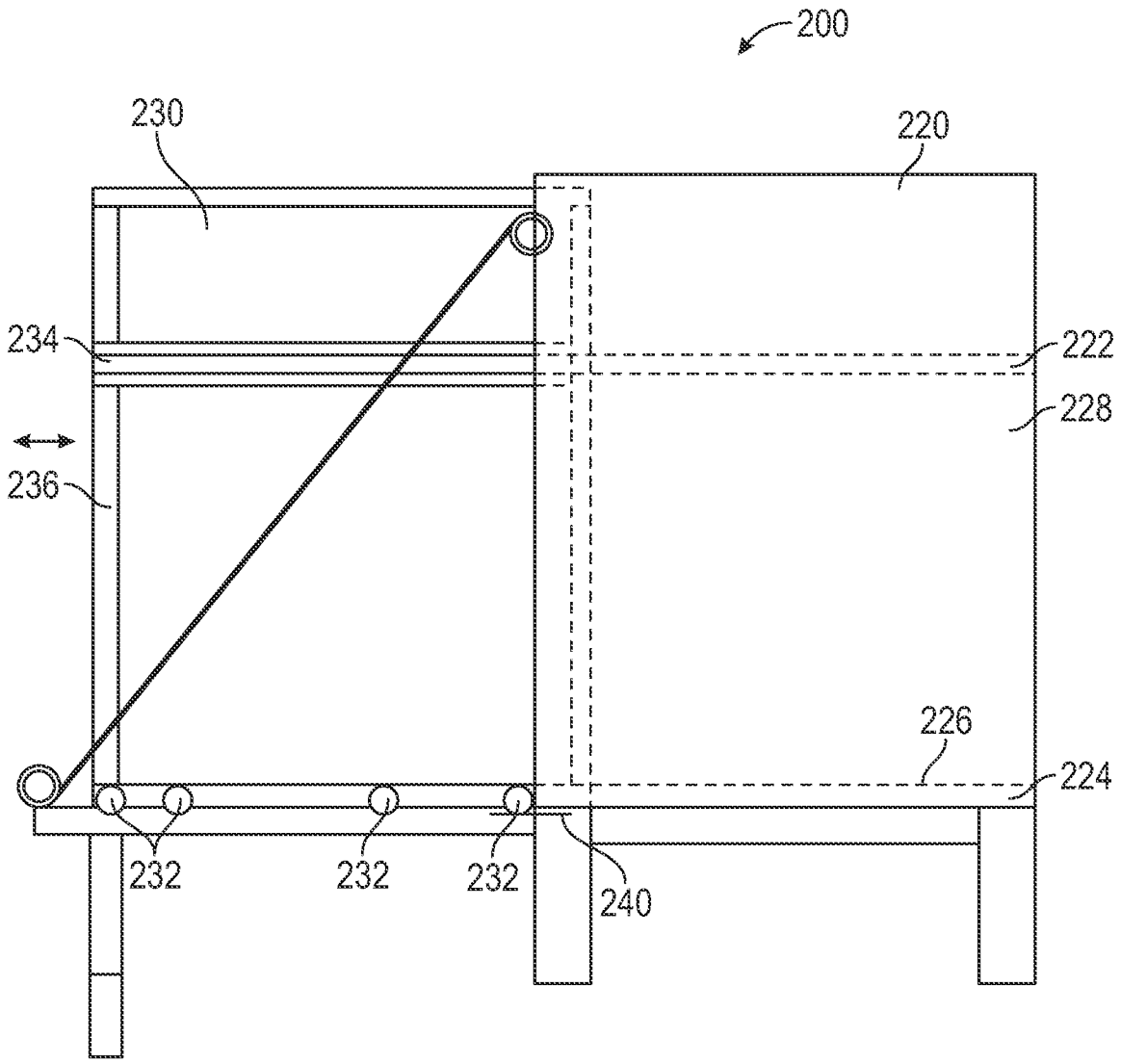
FIG. 12 is a schematic side view of an implementation of nested components in an extended position.

FIG. 12 is a schematic side view of an implementation of a nested house 200 in an extended position. As illustrated, an outer portion or component 220 is designed to house an inner portion or inner component 230, i.e., inner component 230 is configured to nest within outer component 220. In the implementation shown, inner component 230 moves with respect to outer component 220 which remains stationary. Inner component 230 includes wheels or casters 232 attached to a lower end of sidewall 236. In particular implementations, each wall having casters attached thereto may have four casters attached thereto. The casters may be located as indicated by FIG. 12 in order to support the weight of the second portion when extended from the first portion. In other implementations, each wall having casters attached thereto may have a different number of casters or a different location of casters as what is illustrated by FIG. 12. Casters are received in a channel 224 and engage a rail or track therein. Channel 224 may be configured such that casters 232 are recessed below an upper surface 226 of flooring of outer component 220 and inner component 230. In various implementations, an upper surface 226 of the flooring of outer component 220 and inner component 230 is about planar or level and is designed to feel and appear continuous. Casters 232 remain recessed in channel 224 as inner component 230 slides into and out of outer component 220.

In various implementations, any of the nested houses disclosed herein may include one or more floor supports 240, as illustrated by FIG. 12. In such implementations, the convertible wall or floor for the second portion when in the extended portion may fold down. After the floor is folded down, one or more floor supports 240 may be bridged between the first portion and the second portion. In various implementations, the one or more floor supports may be configured to slide from either the first portion or the second portion into respectively the second portion or the first portion. In other implementations, the one or more floor supports may be removably attachable to both the first and second portions. The one or more floor supports 240 may be configured to lock into place when bridging first and second portions of the nested house. When installed, the one or more floor supports 240 may provide additional support to the floor of the second portion when in an extended position and may ensure that the floor of the second portion is aligned with and planar to the floor of the first portion.

In order to maintain balance and alignment, tongue 222 and groove 234 are also provided on outer component 220 and inner component 230, respectively, such that sidewall 236 is in meshing engagement with sidewall 228. The tongue 222 of sidewall 228 engages the groove 234 of sidewall 236. As illustrated, tongue 222 and groove 234 are in an upper half of a height of sidewalls 236, 228 to provide further support, alignment and balance. Any style of male and female fasteners or connectors may be used. In some implementations, wheels in a rail, track or channel, may also be used to mesh or engage sidewall 236 with sidewall 228. In various implementations, the tongue and groove or wheels and rail, track or channel may be located at any desired height along sidewalls 236 and 228.

Figure 13:
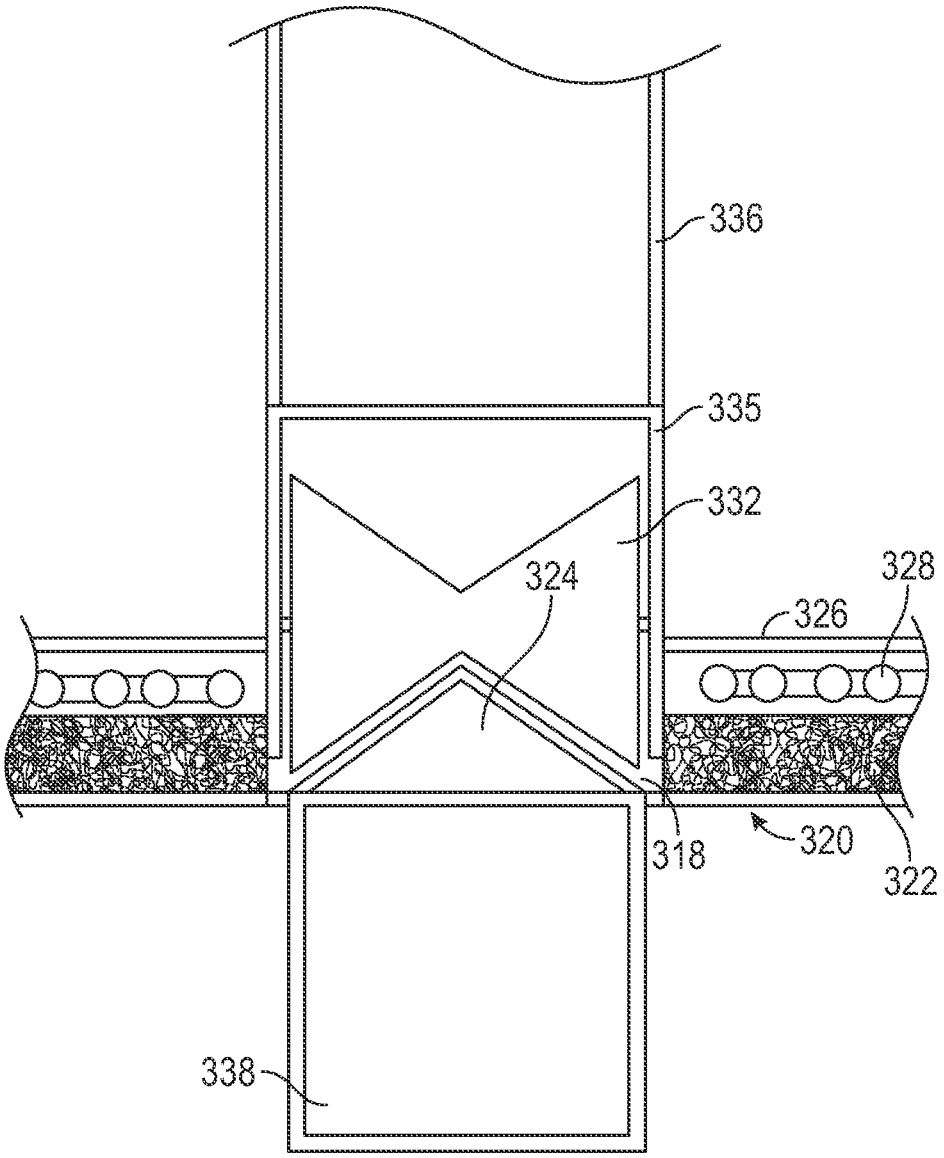
FIG. 13 is a schematic cross section of an implementation of a channel in a floor of a nested house.

FIG. 13 is a schematic cross section of an implementation of a channel in a floor of a nested house. FIG. 13 illustrates a floor 320 having a channel 318 disposed therein. In particular implementations, the channel 318 is recessed into floor 320. The floor 320 has an upper surface 326 and may also include radiant heating 328 and insulation 322, which may include foam or any other type of insulation. Sidewall 336 includes casters 332 on a bottom end thereof. A cover, shield, housing or bracket 335 may be provided to shield casters 332 and hide casters 332 in sidewall 336. Alternatively, casters may be mounted directly into an opening in sidewall 336. Casters 332 are coupled within channel 318 and engage a rail 324 therein. In the implementation shown, rail 324 is recessed below the upper level 326 of the floor 320. A beam or support 338 may be provided to bear weight of sidewall 336. In some implementations, casters 332 are industrial V-groove casters designed to engage a V-shaped rail, track or channel.

Figure 15:
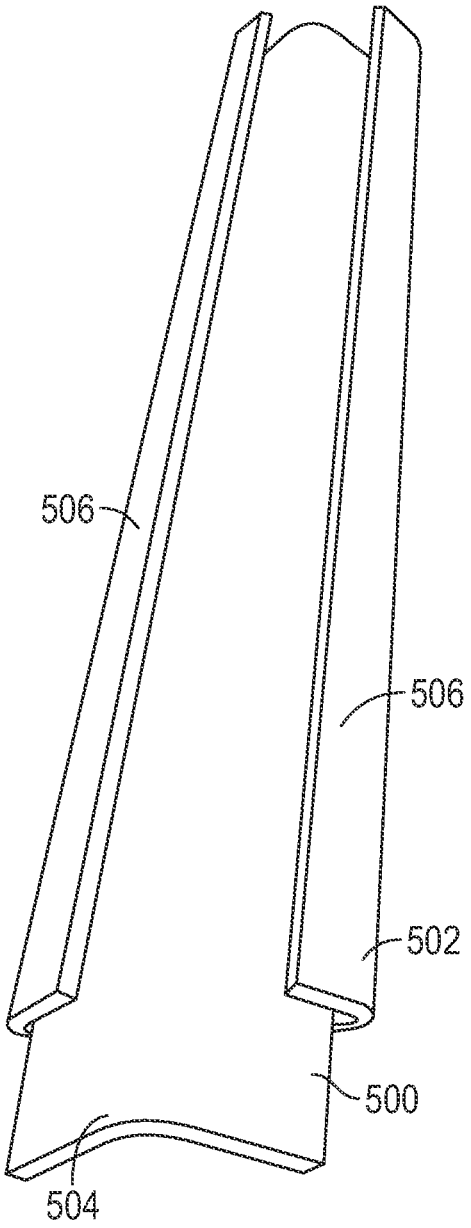
FIG. 15 is a perspective view of an implementation of a track.
Figure 16:
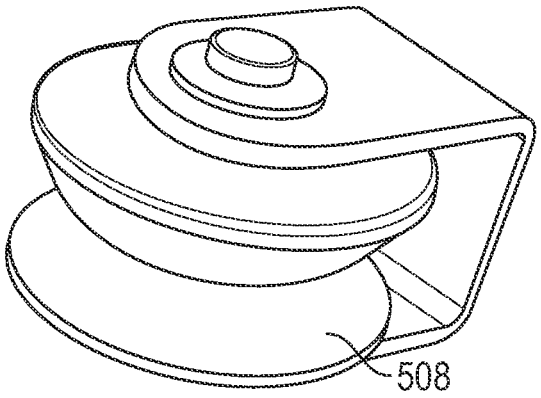
FIG. 16 is a perspective view of an implementation of a caster configured to roll upon the track.
Figure 17:
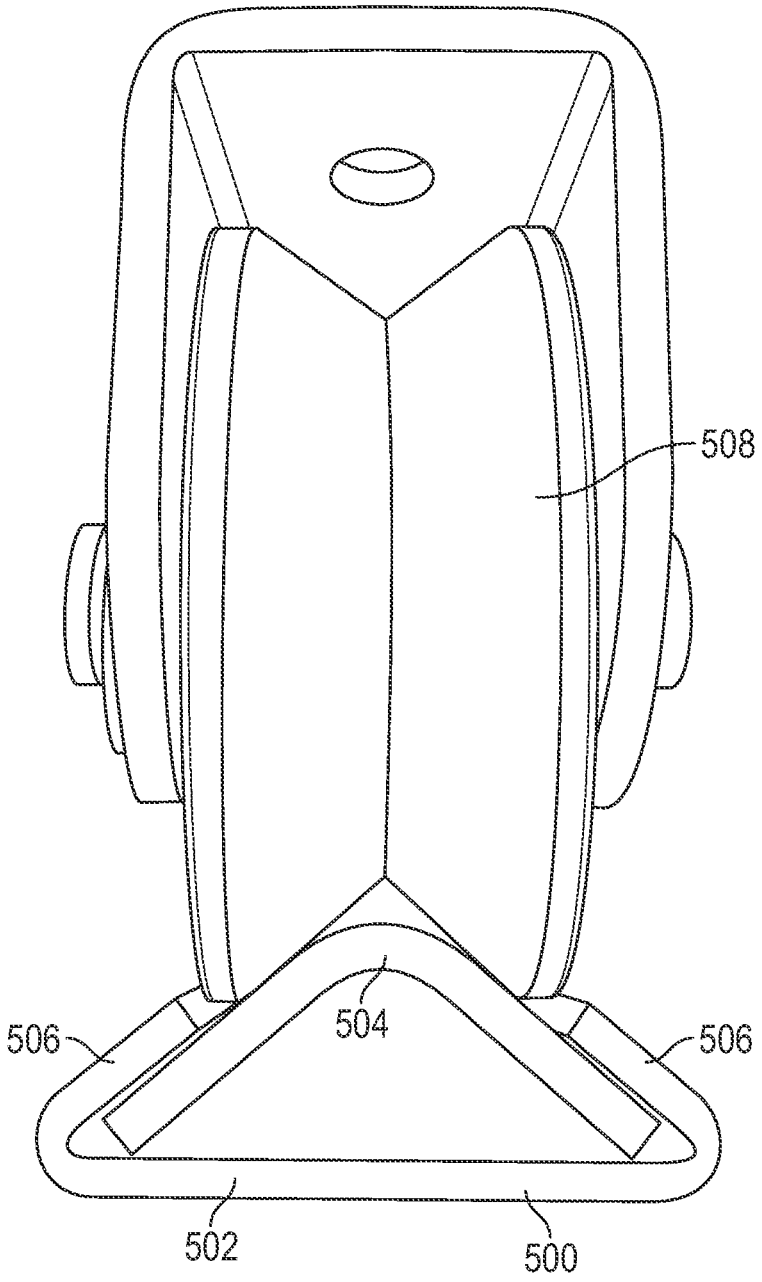
FIG. 17 is a front view of the castor of FIG. 16 on the track of FIG. 15.

Referring to FIG. 15, is a perspective view of an implementation of a track is illustrated. Referring to FIG. 16, a perspective view of an implementation of a caster configured to roll upon the track is illustrated. Referring to FIG. 17, a front view of the castor of FIG. 16 on the track of FIG. 15 is illustrated. Any of the tracks and casters disclosed herein may be the same as or similar to the track of FIG. 15 and the caster of FIG. 16. In various implementations, the track 500 on which the second portion rolls upon may include a base 502 separable from the rail 504. The rail 504 may be V-shaped. The base 502 may include a tab 506 on either side of the base configured to engage and secure the rail 504. In such implementations, the base may be bolted or otherwise secured to the first portion of the nested house. The rail 504 may then slide into the base 502 after the base is secured to the first portion. In such implementations, if the rail 504 is ever damaged it may be removed and replaced without having to remove the base 502.

Referring to FIGS. 16-17, the second, or extendable, portions disclosed herein may include a plurality of casters 508 configured to roll along the rail 504 of the track 500.

Figure 14:
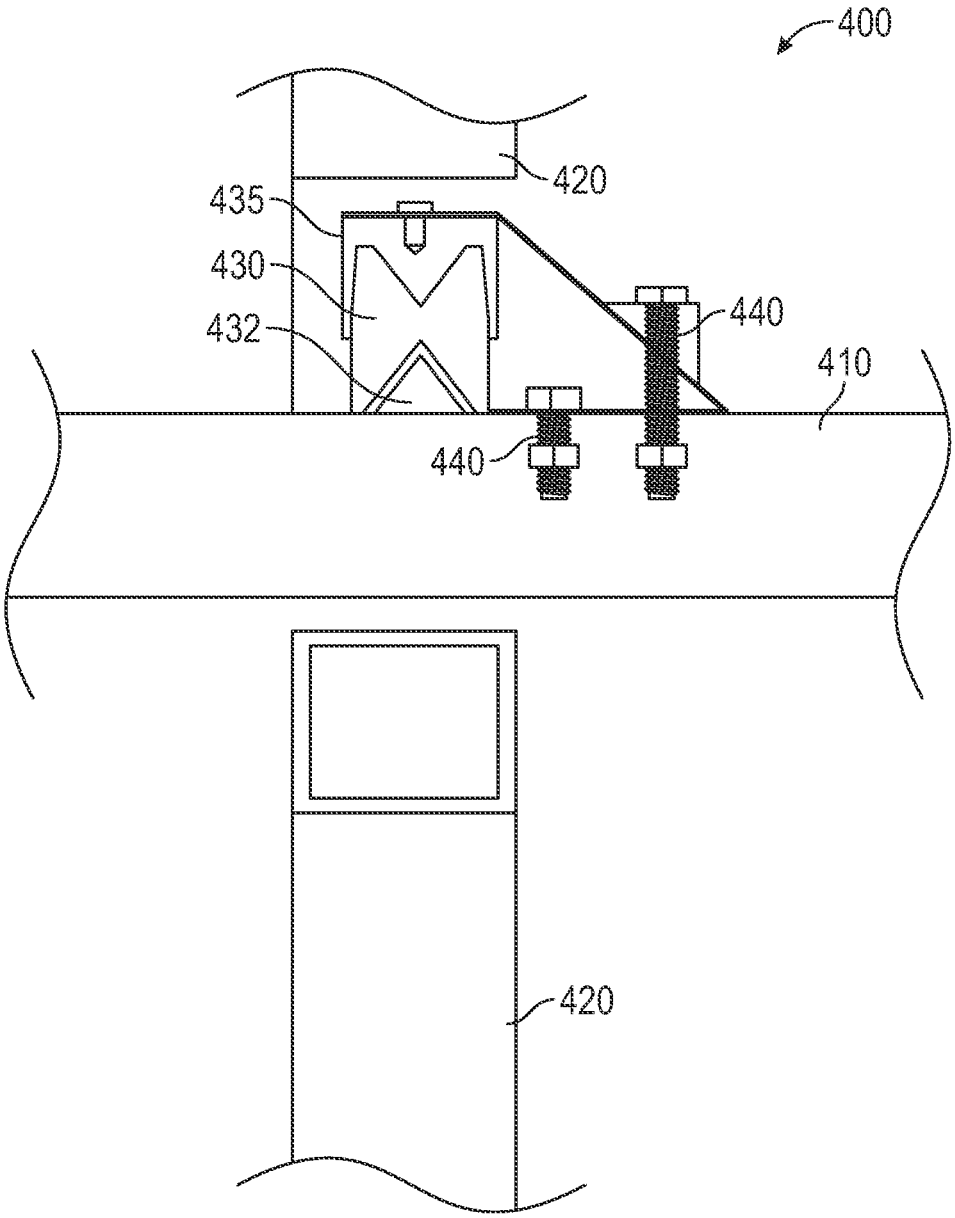
FIG. 14 is a schematic cross section of an implementation of a channel in a wall of a nested house.

Referring to FIG. 14, a schematic cross section of an implementation of a channel in a wall of a nested house is illustrated. In various implementations, the loft 410, or other support attached to a sidewall of the first portion, may include one or more casters 430 coupled thereto. The casters may be coupled to the loft 410 or support through the bracket 435 fixedly attached to the first portion of the nested house. In various implementations, the bracket 435 may be attached to the loft 410 or support through one or more bolts 440, screws, welds, clamps, or other attachment mechanisms. In the implementation illustrated by FIG. 14, the wall 420 of the second portion may include a track 432 fixedly coupled thereto. The track 432 may be pulled out with the wall 420. The track 432 may be recessed within the wall 420. The one or more casters 430 with the track 432 may facilitate smooth sliding of the second portion of the nested house inasmuch as the second and first portions may engage along upper and lower tracks. In other implementations, the nested house may not include any upper tracks or casters.

In places where the description above refers to particular implementations of nested houses and nested containers and implementing components, sub-components, methods and sub-methods, it should be readily apparent that a number of modifications may be made without departing from the spirit thereof and that these implementations, implementing components, sub-components, methods and sub-methods may be applied to other nested houses and nested containers.

What is claimed is:

1. A nested house comprising:

a first portion comprising a stationary wall, a convertible wall, a platform forming a floor of a loft, and a first floor; and a second portion comprising a first movable wall, a second movable wall, and a third movable wall, the second portion movable with respect to the first portion between a compact position and an extended position, the second portion configured to nest within the first portion;

wherein the convertible wall is configured to rotate downwards to form a second floor of the second portion in the extended position; and wherein the first moveable wall comprises a slot through an entire thickness of the first moveable wall, wherein a portion of the platform is coupled within the slot.

2. The nested house of claim 1, wherein the convertible wall is pivotable between the compact position and the extended position.

3. The nested house of claim 1, wherein the slot extends only across a portion of a width of the first moveable wall, wherein a closed end of the slot is configured to prevent the second portion from being entirely pulled out of the first portion.

4. The nested house of claim 1, wherein one of a bathroom fixture or a kitchen fixture is secured to the first floor or the stationary wall.

5. The nested house of claim 1, wherein in the extended position, an upper surface of the first floor is coplanar with an upper surface of the second floor.

6. The nested house of claim 5, further comprising a track below the upper surface of the first floor and the upper surface of the second floor.

7. The nested house of claim 6, wherein the track comprises a base and a rail, wherein the rail is configured to slide within the base.

8. The nested house of claim 1, wherein the stationary wall of the first portion is in meshing engagement with one of the first movable wall, second movable wall or third movable wall of the second portion.

9. The nested house of claim 8, wherein the meshing engagement occurs in an upper half of the stationary wall and an upper half of the first movable wall.

10. The nested house of claim 1, wherein at least one of the first movable wall, the second movable wall, or the third movable wall is mounted on wheels or casters.

11. The nested house of claim 10, further comprising a track for engaging the wheels or casters.

12. The nested house of claim 11, wherein the track is below an upper surface of the first floor or an upper surface of the second floor.

13. The nested house of claim 1, further comprising fixtures attached to at least one of the first movable wall, the second movable wall, or the third movable wall.

14. The nested house of claim 1, wherein at least one of the first movable wall, the second movable wall, or the third movable wall is recessed into one of the first floor or the second floor.

15. The nested house of claim 1, further comprising a trailer, the first portion resting on the trailer.

16. A nested house comprising:

a first portion comprising a first stationary wall, a second stationary wall, and a third stationary wall, a stationary floor, and a stationary ceiling;

a second portion comprising a first movable wall, a second movable wall, a third movable wall, and a movable ceiling;

a foldable wall;

wherein one of the first portion is configured to nest within the second portion or the second portion is configured to nest within the first portion;

wherein the foldable wall is configured to fold down from a wall position to a floor position under the second portion;

wherein a width of the first portion perpendicular to a longest length of the first portion is substantially the same as a width of the second portion perpendicular to a longest length of the second portion;

wherein the stationary floor includes a track comprising a first base and a first rail;

wherein the foldable wall includes a track comprising a second base and a second rail; and wherein the first rail and the second rail are configured to be replaced while the second portion is coupled within the first portion.

17. The nested house of claim 16, wherein the first portion comprises a loft.

18. The nested house of claim 16, wherein the second portion is movable with respect to the first portion, wherein in the floor position, the second portion is moved away from the first portion such that the foldable wall forms a floor under the second portion.

19. A nested house comprising:

a trailer;

a first portion on the trailer, the first portion comprising a stationary wall, a convertible wall, a platform forming a floor of a loft, and a first floor;

a second portion comprising a first movable wall, a second movable wall, and a third movable wall, the second portion movable with respect to the first portion between a compact position and an extended position, the second portion configured to nest within the first portion;

a rail, a track or a channel recessed into the convertible wall;

wherein the convertible wall is configured to rotate downwards to form a second floor of the second portion in the extended position;

wherein the first moveable wall comprises a slot through an entire thickness of the first moveable wall, wherein a portion of the platform is coupled within the slot;

wherein the slot extends only across a portion of a width of the first moveable wall;

wherein a closed end of the slot is configured to prevent the second portion from being entirely pulled out of the first portion; and wherein the second portion engages the rail or track in the extended position.

20. The nested house of claim 19, wherein the first moveable wall is coupled to and between an edge of the platform and the stationary wall.

* * * * *